United States Patent [19]

Kakizaki

[11] Patent Number: 4,861,308

[45] Date of Patent: Aug. 29, 1989

[54] DRIVE CONTROL MECHANISM FOR SPRING-DRIVEN TOY

[75] Inventor: Katsumi Kakizaki, Tokyo, Japan

[73] Assignee: Tomy Kogyo Co., Inc., Tokyo, Japan

[21] Appl. No.: 315,188

[22] Filed: Feb. 27, 1989

Related U.S. Application Data

[63] Continuation of Ser. No. 122,342, Nov. 18, 1987, abandoned.

[30] Foreign Application Priority Data

Nov. 18, 1986 [JP] Japan ..... 61-177378

[51] Int. Cl.[4] ..... A63H 33/26; A63H 3/52

[52] U.S. Cl. ..... 446/129; 446/476; 446/314

[58] Field of Search ..... 446/130, 129, 132, 133, 446/134, 135, 136, 137, 138, 476, 236, 268, 461, 314; 273/1 M, 239, 142 JB; 272/31 R

[56] References Cited

U.S. PATENT DOCUMENTS

| | | | |
|---|---|---|---|
| 355,893 | 1/1887 | Sternberg | 74/2 X |
| 2,279,386 | 4/1942 | Carver | 446/433 |
| 2,505,626 | 4/1950 | Palmer | 446/130 |
| 2,549,980 | 4/1951 | Machesney | 446/464 X |
| 2,735,222 | 2/1956 | Glass | 446/461 |
| 3,169,345 | 2/1965 | Marmo et al. | 446/130 |
| 3,411,237 | 11/1968 | Crosman | 446/132 |
| 3,867,786 | 2/1975 | Greenblatt | 446/130 |
| 3,961,440 | 6/1976 | Saito | 446/464 |
| 4,091,561 | 5/1978 | Kimura | 446/137 |

FOREIGN PATENT DOCUMENTS

| | | | |
|---|---|---|---|
| 670854 | 1/1939 | Fed. Rep. of Germany | 446/461 |
| 2211468 | 9/1973 | Fed. Rep. of Germany | 446/130 |
| 3611503 | 7/1987 | Fed. Rep. of Germany | 446/129 |
| 1106398 | 12/1955 | France | 446/461 |
| 56-4066 | 1/1980 | Japan . | |
| 60-9815 | 1/1982 | Japan . | |
| 62-14874 | 10/1983 | Japan . | |
| 61-25518 | 2/1984 | Japan . | |
| 62-13839 | 8/1984 | Japan . | |
| 2077117 | 12/1981 | United Kingdom | 446/130 |

*Primary Examiner*—Mickey Yu
*Attorney, Agent, or Firm*—Staas & Halsey

[57] ABSTRACT

A spring driven toy is described, including a base; an operation member movably mounted on the base; a spring unit for moving the movable operation member relative to the base; a speed control mechanism connected to the spring unit; a lever selectively movable between a position engaged to the speed control mechanism to prevent the spring unit from operating and a position disengaged therefrom to allow the spring unit to operate, said lever including a first magnetic substance; and a separate body having a second magnetic substance and being magnetically attachable to the movable operation member adjacent the first magnetic substance of the lever and movable with the movable operation member. When the body is positioned on the movable operation member adjacent the first magnetic substance of the lever, the lever moves due to magnetic forces of the first and second magnetic substance from the engaged position to the disengagaed position, thereby allowing the spring unit to operate and move the movable operation member with the body thereon relative to the base. When the body is removed from the movable operation member, the lever returns to its original position engaged with the speed control mechanism, thereby preventing the spring unit from operating and moving and movable operation member.

9 Claims, 6 Drawing Sheets

DRIVE CONTROL MECHANISM FOR SPRING-DRIVEN TOY

This is a continuation of co-pending application Ser. No. 122,342 filed on 11/18/87, now abandoned.

BACKGROUND OF THE INVENTION

The present invention relates to a drive control mechanism for a toy which is capable of controlling the operation of a spring drive mechanism by putting a placing body, including a permanent magnet, on and off an operation member provided with the spring drive mechanism.

A permanent magnet has often been used as a part of the connecting mechanism or the driving mechanism for a toy. It has been known to directly move one or more members, each having a permanent magnet, by using the attracting and repelling force of two permanent magnets, or to associate a first permanent magnet with a driving mechanism so as to indirectly operate a member including a second permanent magnet which is attracted to the first permanent magnet through a partition interposed between the two permanent magnets.

SUMMARY OF THE INVENTION

The present invention is an improvement of the foregoing conventional art, wherein the operation of the spring drive mechanism provided for the operation member can be controlled by means of the magnetic force of a permanent magnet incorporated in the placing body having an appearance such as a doll.

The present invention includes an operation member operably mounted relative to a housing and provided with a spring drive mechanism having a transmission gear train and an output shaft, the transmission gear train including a plurality of gears; a movable lever which receives at its base a magnetic substance, such as iron or a permanent magnet, and is engageable with and disengageable from a speed control mechanism such as a governor of the spring drive mechanism at its tip portion. The output shaft of the spring drive mechanism is associated with the operation member to operate it directly or indirectly through a driving force transmission member. By placing an attracting magnetic substance or a permanent magnet mounted at the lower end of the placing body on a predetermined position of said housing, said lever with a permanent magnet or magnetic substance is moved. and The tip of the lever is spaced apart from the speed control mechanism of the spring drive mechanism to release the spring drive mechanism to operate the operation member.

The foregoing spring drive mechanism arranged in the operation member has a feature that it is operated by putting the placing body incorporated therein with the magnet or magnetic substance on a proper position of the operation member, and stops its operation when the placing body is removed from the operation member.

DETAILED DESCRIPTION OF THE PREFERRED EMBODIMENTS

Figure 1:
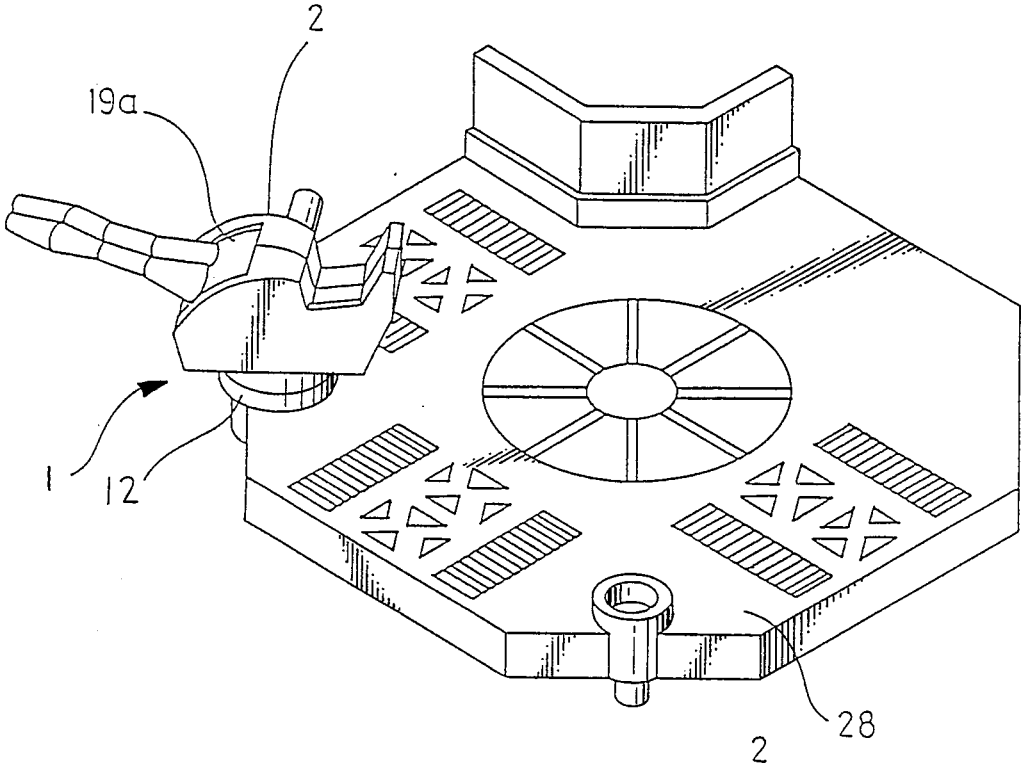
FIG. 1 is a perspective view showing the first embodiment of the invention.
Figure 3:
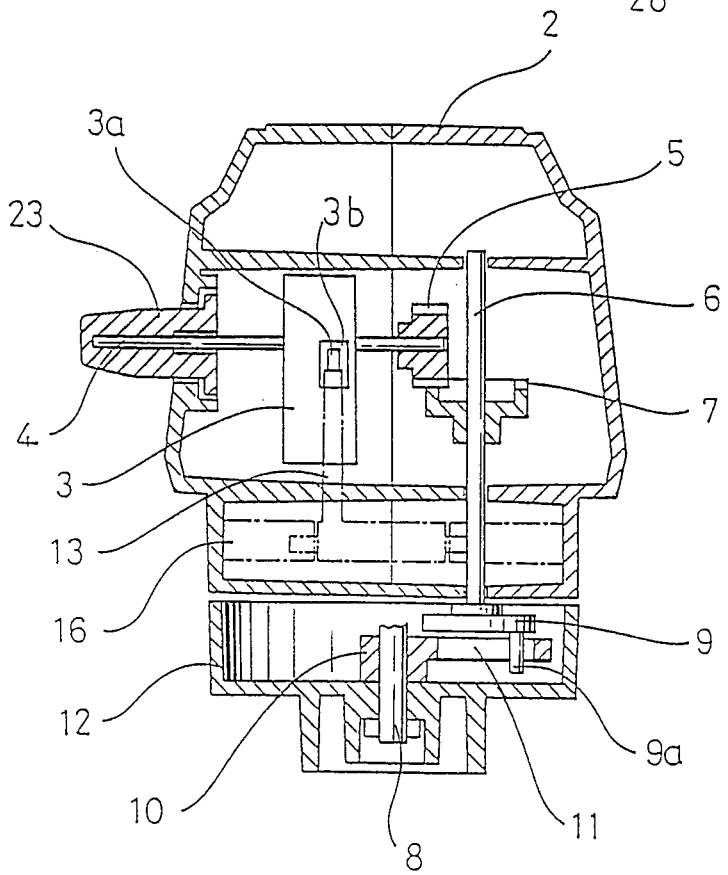
FIG. 3 is longitudinal sectional view the operation member seen from the front.
Figure 2:
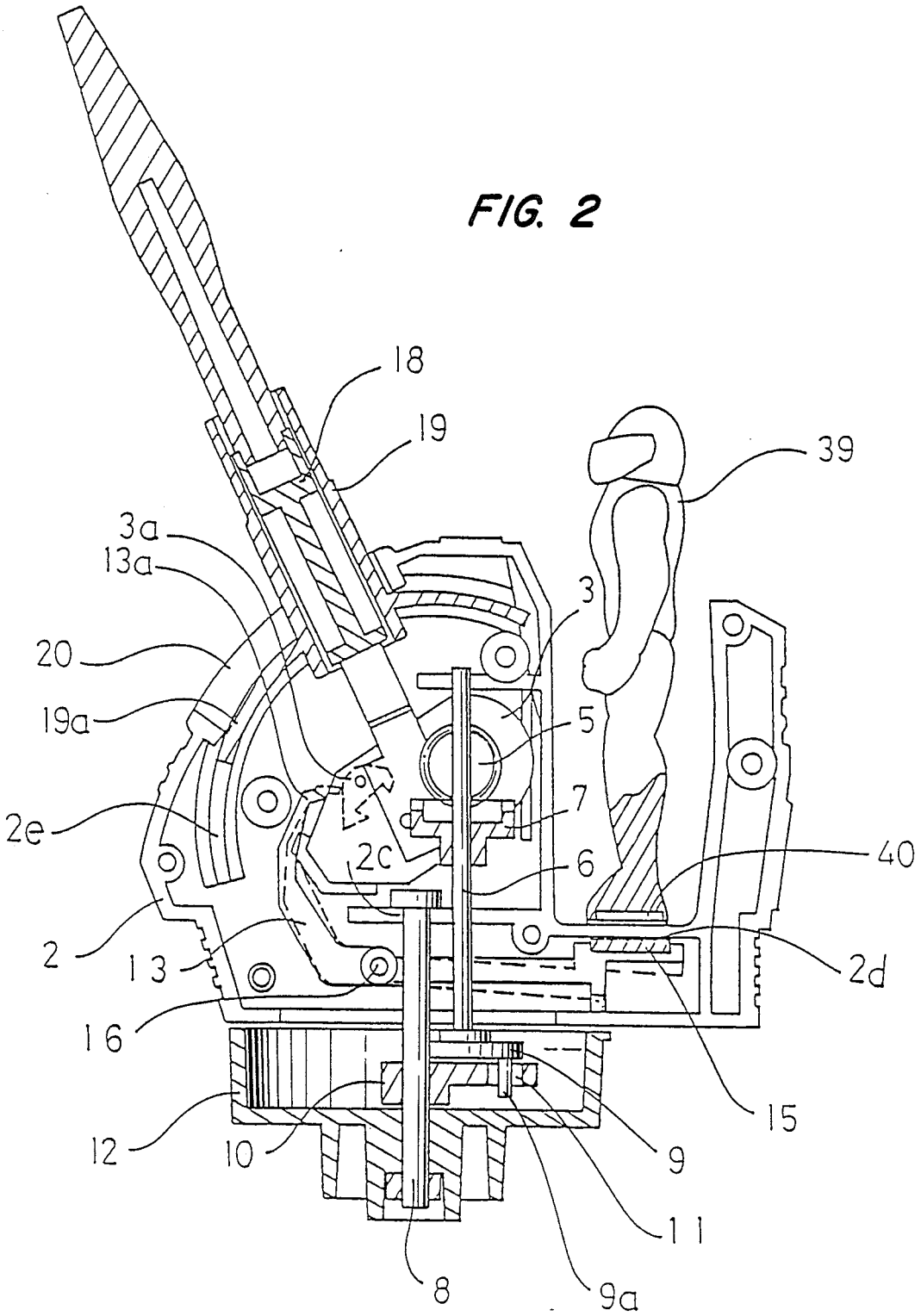
FIG. 2 is a longitudinal sectional view of an operation member.
Figure 4:
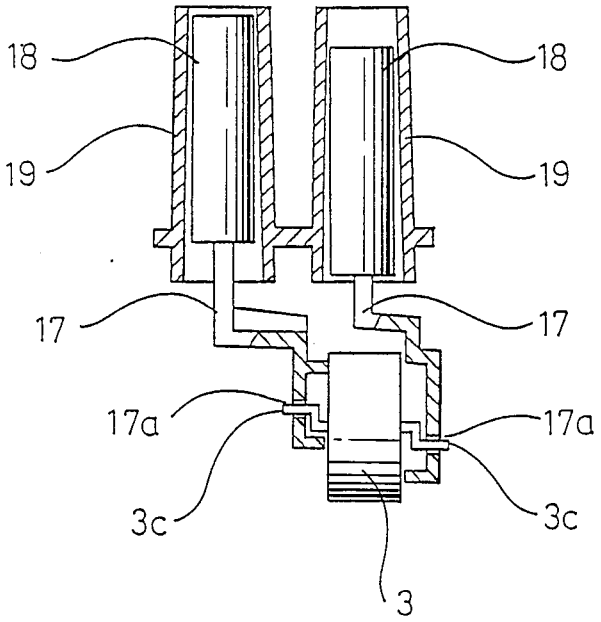
FIG. 4 is a plan view partly broken showing a portion of the operation member.

FIGS. 1–4 illustrate a first embodiment of the present invention, and FIGS. 5–9 illustrate a second embodiment thereof.

In the first embodiment, an operation member 1 has a housing 2 of a turret-shape and is rotatably supported on a circular member base 12. The lower end of the circular member base 12 is rotatably fitted in a mounting board 28. A spring unit 3 including a spring and a predetermined gear train (not shown) is arranged in the housing 2. A governor serving as a speed control mechanism **3*a* which is operated in association with a final gear of the gear train is provided inwardly of an opening 3*b* of the spring unit 3**.

An output shaft 4 passes through the spring unit 3 and is mounted at one end with a handle 23 projecting outwardly of the housing 2 and at the other end with a gear 5. The gear 5 meshes with a crown gear 7 which is mounted onto a gear shaft 6 provided vertically of the housing 2. A crank 9 is attached to the lower end of the gear shaft 6 and a pin **9*a*, which is part of the crank 9, is disposed in the circular member base 12, and inserted into an elongated opening 11 of an arm 10 which is mounted onto a support shaft 8. The support shaft 8 is rotatably supported by the circular member base 12 at its lower end and is fixed to a hole 2*c* of the housing 2. Accordingly, when the gear shaft 6 is rotated by the crown gear 7, which is engaged with the gear 5 of the spring unit 3, the support shaft 8 is rotated through the arm 10 so that the housing 2 is rotated on the support shaft 8 at predetermined angles on a horizontal plane, being supported by the support shaft 8**.

A turnable lever 13 is formed in a shape similar to "L", and is pivoted at its intermediate portion by a shaft 16 to be able to turn. The turnable lever 13 is attached at its base with magnetic means such as a magnetic substance 15, and is formed with an engaging detent **13*a* at its standing tip. The engaging detent 13*a* is engageable with, and disengageable from, the governor serving as the speed control mechanism 3*a* provided inwardly of the opening 3*b* of the spring unit 3. The upper section of the magnetic substance 15 mounted on the turnable lever 13 is formed as a placing section 2*d* which is a part of the housing 2 and receives a placing body 39 thereon. When the placing body 39 incorporated with a second magnetic means, such as a permanent magnet 40, is placed on the placing section 2*d*, the turnable lever 13 turns in a counterclockwise direction in FIG. 2 and the engaging detect 13*a* formed at the tip of the turnable lever 13 disengages from the speed control mechanism 3*a* of the spring unit 3 so that the driving mechanism 3*c* of the spring unit 3 is unlocked. As the turnable lever 13 is formed heavier at its base than at its tip with respect to the shaft 16 serving as a fulcrum, when the placing body 39 is removed from the placing section 2*d*, the weight of the base of the lever 13 causes the turnable lever 13 to turn in a clockwise direction in FIG. 2, so that the engaging detent 13*a* formed at the tip engages the speed control mechanism 3*a*** of the spring unit 3 to prevent the driving mechanism 3c of the spring unit 3 from being operative.

Cannon barrels 19 project through an opening 20 formed in the housing 2 and are integrally formed with an arc-shaped support plate 19a at the base end. The support plate 19a is fitted at its edges into guide grooves 2e formed in the inner wall of the housing 2 to support the cannon barrels 19 turnably up and down. Each cannon barrel 19 receives a movable member 18 which is connected at its base with a tip of a connecting plate 17. The connecting plates 17 are formed with holes 17a, 17a at their bases, respectively. The driving mechanisms, 3a, in the form of a pair of crankshafts 3c, 3c, which are rotated in a association with a desired gear shaft (not shown) of the spring unit 3, are loosely fitted in the through holes 17a, 17a. When the housing 2 of a turret-shape repeatedly turns at the predetermined angles on the horizontal plane, the movable members 18 within the cannon barrels alternately appear and disappear.

Now, an appearance of said placing body 39 is not limited to a doll, and includes an appearance of an animated robot and/or animal, or an automobile. Moreover, the first and second magnetic means can include a permanent magnet 15 mounted to the turnable lever 13 and a permanent magnet 40 mounted on the placing body 39. When the placing body 39 is placed on the predetermined position 2d of the housing 2, the turnable lever 13 is moved by the magnetic force, since the different poles of the permanent magnets for the turnable lever 13 and the placing body 39 are opposite to each other. Further, either the permanent magnet or the magnetic substance can be mounted to the turnable lever 13 or the placing body 39. These combinations of magnetic substance or permanent magnet mounted to the turnable lever 13 and/or the placing body 39 are also suited for the second embodiment which is described later.

Figure 5:
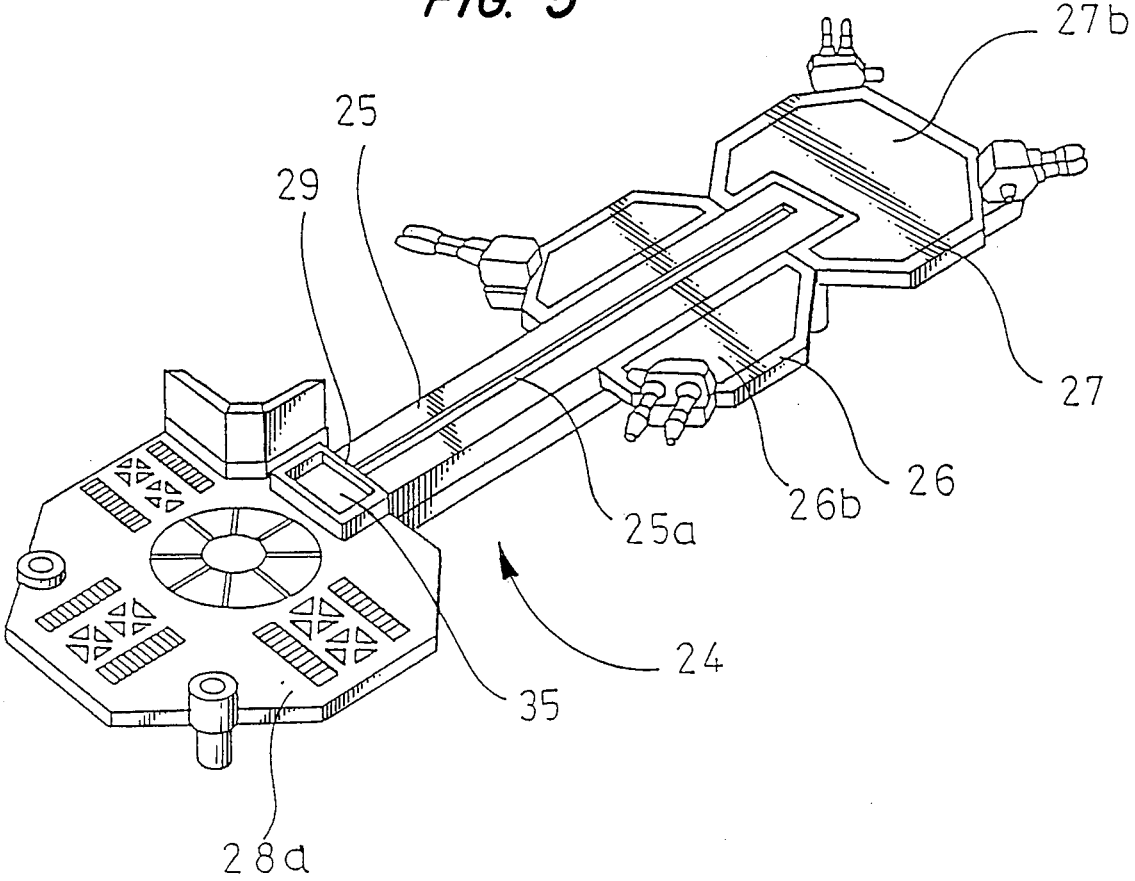
FIG. 5 and FIG. 6 are perspective views showing the second embodiment.
Figure 6:
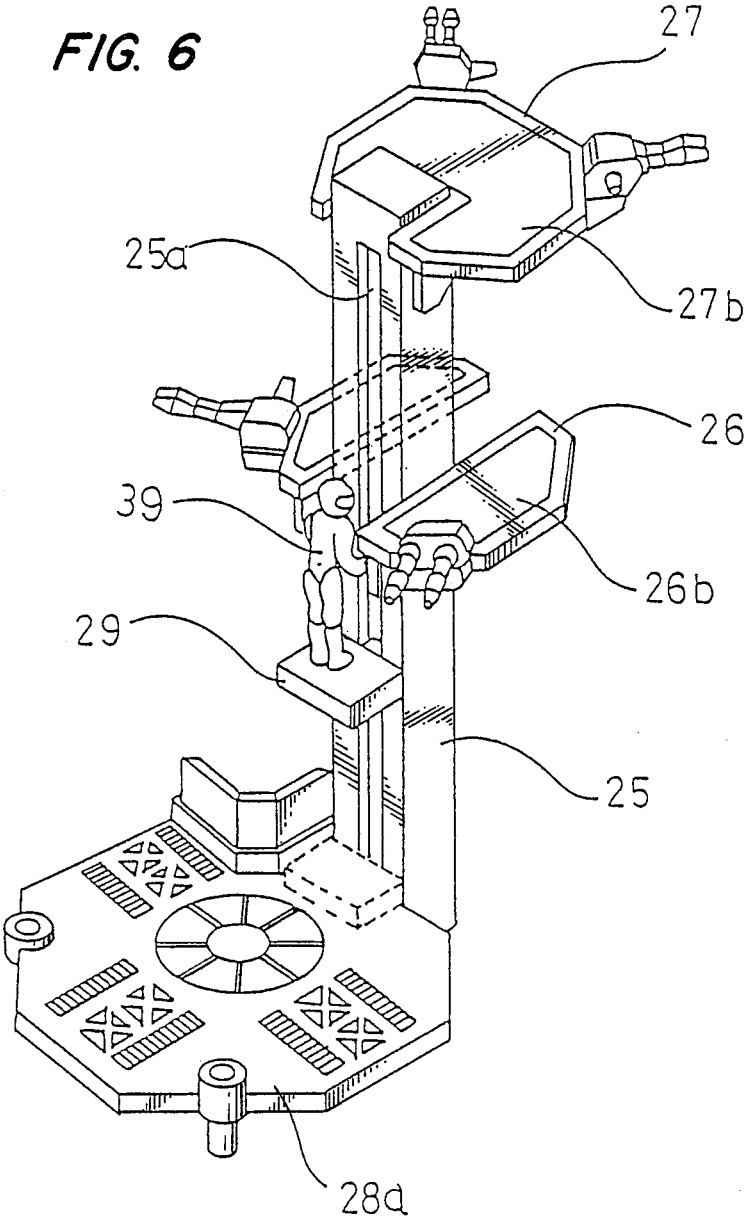
Figure 7:
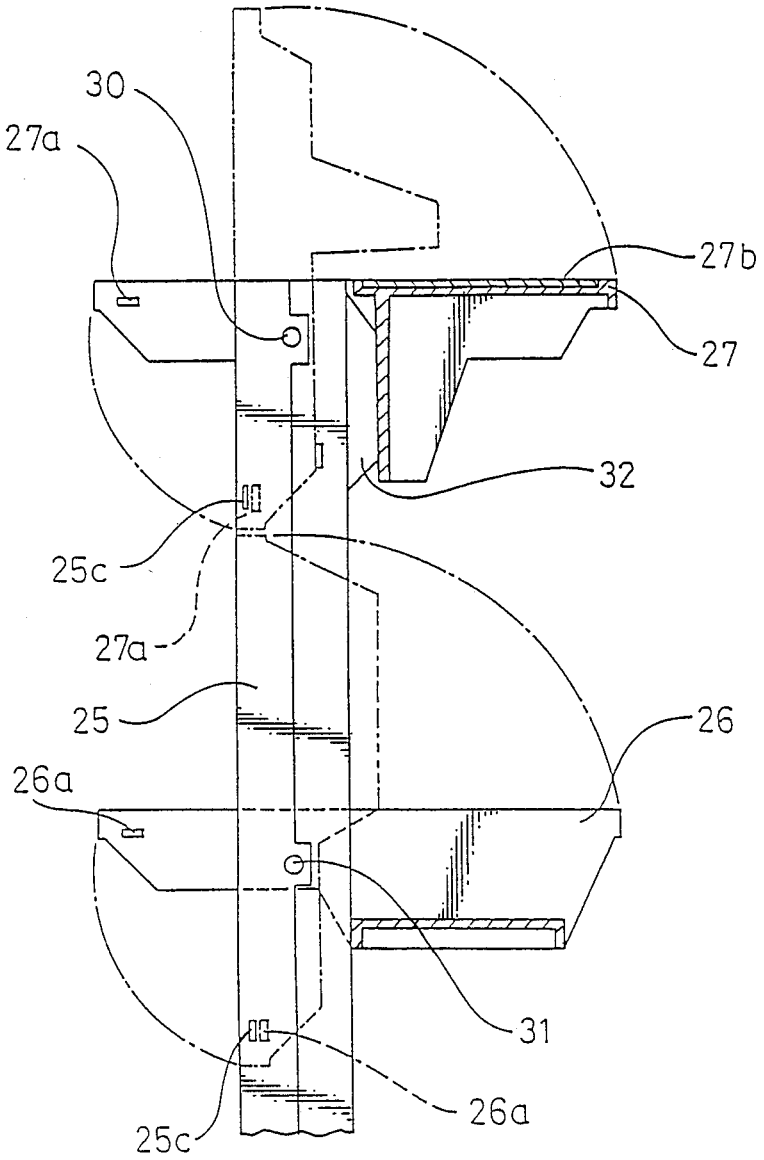
FIG. 7 is a sectional view of the movable plates.

In the second embodiment, the base 24 is constituted by a mounting board 28a, a tower 25 hinged to the mounting board 28a and two movable plates 26, 27 pivoted to the tower 25. The tower 25 is formed at its central portion with a rectangular opening 25a extending longitudinally of the tower 25. Through the opening 25a is inserted a movable operation member 29, which is movable along the opening 25a by a spring drive mechanism incorporated therein. FIG. 5 shows the tower 25 positioned horizontally, wherein the placing body 39 is put on the movable operation member 29 to be moved horizontally. FIG. 6 shows the tower 25 standing upright with respect to the base 28a, wherein the placing body 39 is placed on the movable member 29 to be moved vertically.

On the upper surfaces of the movable plates 26, 27, which are turnably pivoted to the tower 25 at the support shafts 30, 31 respectively, are attached plain plates 26b, 27b formed if a magnetic substance such as iron so as to enable the placing body 39 to stand upright stably thereon by means of the permanent magnet 40 of the placing body 39 attracted thereto. When the tower 25 is laid horizontally, the upper surfaces of the tower 25 and the movable plates 26, 27 are kept level by rotating the movable plates 26, 27 in a counterclockwise direction in FIG. 7 to engage projections 26a, 27a provided at the bases of the movable plates 26, 27 with projections 25c, 25c provided on the side wall of the tower 25. A projection 32 is provided at the upper side of the tower 25 for engagement with the movable plate 27 so as to position the upper surface of the movable plate 27 horizontally with respect to the upright tower 25.

Figure 8:
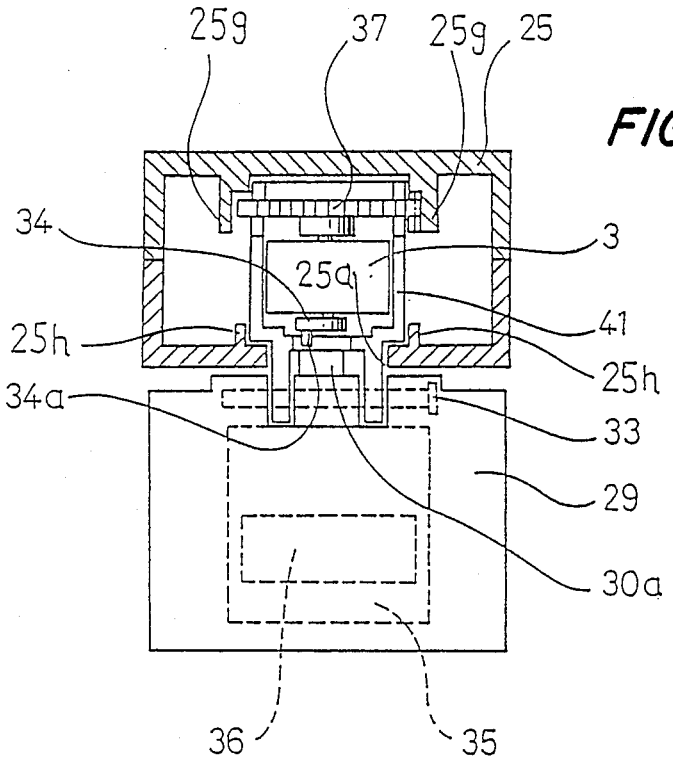
FIG. 8 is a cross-sectional view of the tower.
Figure 9:
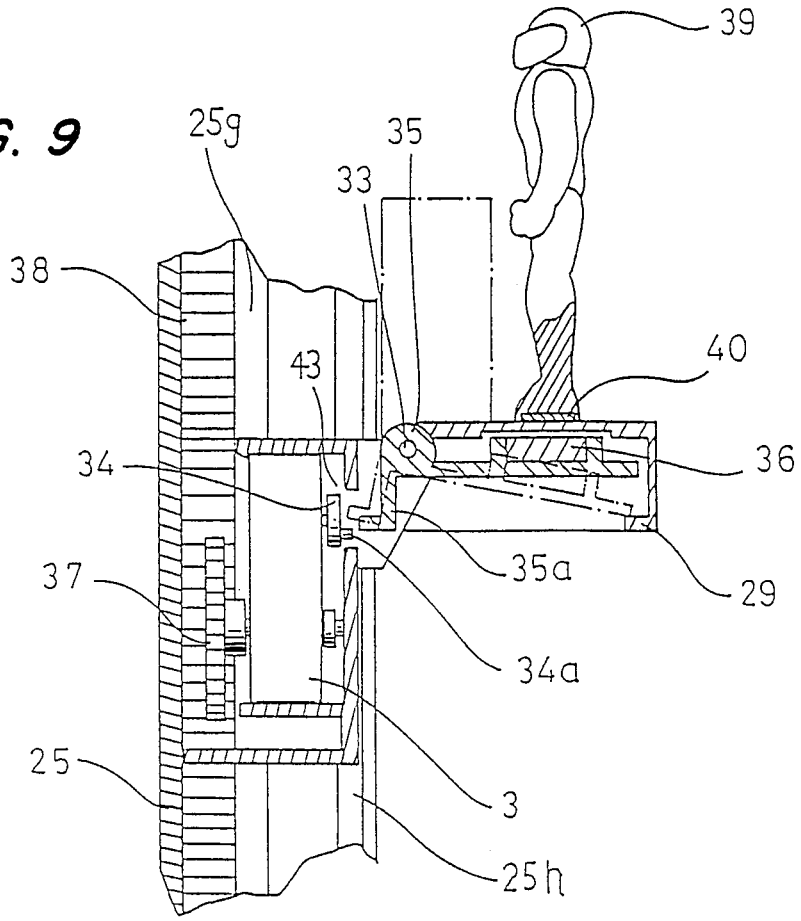
FIG. 9 is a longitudinal sectional view showing the tower and the movable operation member.

As shown in FIGS. 8 and 9, strips 25g, 25g and strips 25h, 25h are formed in the tower 25 at the inner walls thereof. A supporter 41 is arranged among the strips 25g, 25g and the strips 25h, 25h, being movable in the vertical direction. Inside the supporter 41 is fixed the spring unit 3, an output shaft of which is mounted at one end with a gear 37. The gear 37 meshes with a rack 38 formed on the inner wall of one of the strips 25g, 25g. The gear 37 and the rack 38 constitute the driving mechanism 13c and are always in engagement with each other. The driving force is stored in the spring drive unit (not show) by depressing the movable operation member 29 along the tower 25, and the movable operation member 29 goes up by unlocking the spring. A final gear shaft of the transmission gear train (not shown) incorporated in the spring unit 3 is attached with a rotary member 34 serving as the speed control mechanism. The rotary member 34 is provided with a pin 34a at its eccentric position.

The supporter 41 accommodating the spring unit 3 therein is partly projected outward through the opening 25a of the tower 25. At this projected part of the supporter 41 is arranged a support shaft 33 onto which the movable operation member 29 and the turnable lever 35 are mounted at their bases. The turnable lever 35 is receives magnetic means such as a magnetic substance 36 on the upper surface of its tip and is formed with an engageable detent 35a of an "L" shape in section at its base. As shown in FIG. 9, when the placing body 39 is not placed on the upper surface of the movable operation member 29, the turnable lever 35 is positioned as shown by a chain line due to the weight of the magnetic substance 36. Here, the engageable detent 35a formed at the base is positioned inwardly of an opening 43 formed in the supporter 41 and is engaged with the pin 34a of the rotary member 34 to prevent the spring drive mechanism from releasing. When the placing body 39 is put on the upper surface of the movable operation member 29, the magnetic substance 36 is attracted by the magnetic force of the magnetic means in the form of a permanent magnet 40 incorporated in the lower end of the placing body 39 to rotate the turnable lever 35 in a counterclockwise direction in FIG. 9 until it reaches the position shown by a solid line. Accordingly, the engageable detent 35a is spaced apart from the pin 34a to release the spring drive mechanism so that the movable operation member 29 goes up the tower 2 via the driving force.

When the tower 25 is positioned horizontally as shown in FIG. 5, the foregoing drive control mechanism of the spring drive mechanism is not operative irrespective of the placing body 39 getting on or off the movable operation member 29.

The spring drive mechanism arranged in the movable operation member is operated by placing the placing body including the permanent magnet at its lower end on a proper position of the operation member to turn the turnable lever having the magnetic substance, and stops its operation when the placing body is removed from the operation member. Accordingly, it provides the appearance as if the placing body were an operator of the operation member when the placing body is a doll, so that the invention has a wide variety of usage as the drive control mechanism for toys.

I claim:

1. A spring driven toy, comprising:

(a) a base;

(b) an operation member movably mounted on the base;

(i) a spring means for moving the movable operation member relative to the base, (ii) a speed control mechanism connected to the spring means, (iii) a lever selectively movable between a position engaged to the speed control mechanism to prevent the spring means from operating and a position disengaged from the speed control mechanism to allow the spring means to operate, said lever including a first magnetic means; and (c) a separate body having a second magnetic means and being magnetically attachable to the movable operation member adjacent the first magnetic means of the lever and movable with the movable operation member, wherein, when the body is positioned on the movable operation member adjacent the first magnetic means of the lever, the lever moves due to magnetic forces of the first second magnetic means from the engaged position to the disengaged position, thereby allowing the spring means to operate and move the movable operation member with the body thereon relative to the base, and wherein, when the body is removed from the movable operation member, the lever returns to its original engaged position, thereby preventing the spring means from operating and moving said movable member.

2. The toy as recited in claim 1, wherein the spring means includes a transmission gear train and an output shaft.

3. The toy as recited in claim 1, wherein the first magnetic means is a magnetic substance and the second magnetic means is a permanent magnet.

4. The toy as recited in claim 1, wherein each of the first and second magnetic means is a permanent magnet.

5. The toy as recited in claim 1, wherein the movable operation member is a turret including a cannon.

6. The toy as recited in claim 5, wherein the base comprises a circular member and a mounting board.

7. The toy as recited in claim 1, wherein the movable operation member is an elevator.

8. The toy as recited in claim 7, wherein the base comprises a mounting board, a tower and two movable plates.

9. The toy as recited in claim 1, wherein the separate body is configured as a human.

* * * * *

UNITED STATES PATENT AND TRADEMARK OFFICE

CERTIFICATE OF CORRECTION

PATENT NO. : 4,861,308

DATED : August 29, 1989

INVENTOR(S) : KATSUMI KAKIZAKI

It is certified that error appears in the above-identified patent and that said Letters Patent is hereby corrected as shown below:

Figure 8, "30a" should be --35--.

Col. 1, line 34, "housing" should be --base--;
line 49, delete "and".

Col. 2, lines 15-16, delete "base";
lines 31 & 34, delete "base".

Col. 3, line 14, delete "a" before "association";
line 57, "if" should be --of--.

Col. 4, line 12, "13c" should be --3c--;
line 27, delete "is".

Col. 5, line 25, after "first" insert --and--.

Signed and Sealed this

Seventeenth Day of July, 1990

*Attest:*

HARRY F. MANBECK, JR.

*Attesting Officer*

*Commissioner of Patents and Trademarks*